US005310287A

United States Patent [19]

Arentsen

[11] Patent Number: 5,310,287

[45] Date of Patent: May 10, 1994

[54] METHOD AND DEVICE FOR DRIVING A PILE OR THE LIKE INTO AND OUT OF THE GROUND

[75] Inventor: Dik Arentsen, Leiderdorp, Netherlands

[73] Assignee: THC Holland N.V., Ep Sliedrecht, Netherlands

[21] Appl. No.: 892,947

[22] Filed: Jun. 4, 1992

[30] Foreign Application Priority Data

Jul. 5, 1991 [NL] Netherlands ..... 9101179

[51] Int. Cl.[5] ..... E02D 7/30

[52] U.S. Cl. ..... 405/246; 405/251; 405/252; 405/232

[58] Field of Search ..... 405/232, 244, 246, 251, 405/252, 231, 229

[56] References Cited

U.S. PATENT DOCUMENTS 4,365,675 12/1982 Mackinnon ..... 405/232 X
4,610,571 9/1986 Lees ..... 405/251
4,701,077 10/1987 Arentsen ..... 405/246 X
5,170,850 12/1992 Sassak, II ..... 405/232 X

FOREIGN PATENT DOCUMENTS 0206384 12/1986 European Pat. Off. .
1634245 8/1971 Fed. Rep. of Germany .

*Primary Examiner*—Randolph a. Reese
*Assistant Examiner*—J. Russell McBee
*Attorney, Agent, or Firm*—Foley & Lardner

[57] ABSTRACT

Method and device for driving a pile (5) into and out of the ground. The device comprises a hammer (2) provided with a bush (8) protruding away from the hammer in an axial direction and being supported by the hammer and rotatable in relation thereto by remote control means (10). The inner surface of the bush (8) and the pile (5) to be extracted from the ground have been provided with locking dogs (11, 12 respectively). The bush (8) can be partially shoved and rotated onto the pile (5) in an axial direction, so that the top plane of the dogs (11) connected to the bush will come to lie beneath the bottom plane of the locking dogs (12) connected to the pile (5). Thereafter, the pile (5) can be driven out of the ground.

12 Claims, 1 Drawing Sheet

METHOD AND DEVICE FOR DRIVING A PILE OR THE LIKE INTO AND OUT OF THE GROUND

BACKGROUND OF THE INVENTION

1. Field of the Invention

The invention relates first to a method of driving a pile or the like into and out of the ground using a hammer provided with locking dogs connected directly or indirectly therewith, in which the pile has also been provided with locking dogs. A connection can be established between the locking dogs of the pile and the hammer to enable driving the pile out of the ground by means of the hammer.

In applying this method, the hammer will in general be part of a pile driver device. Although in most cases, a pile driver device is only used for driving a pile into the ground, there are cases where the pile should be removed again, for which upwardly directed strokes must be exerted.

2. Discussion of the Related Art

With the known pile driver devices suitable for this purpose, the locking dogs of the hammer and the pile are aligned. A link provided with a slotted hole is fitted across two dogs lying above each other for establishing the coupling between the hammer and the pile.

Generally, two radially opposite links will be present for establishing a proper connection between the hammer and the pile. The links are supported by means of hoisting cables, which can be operated from the pile driver device.

Further, means have been provided for releasing the links from the locking dogs connected to the hammer, so that the hammer sits free on the pile and the pile can be driven into the ground without difficulty. Only when the pile should be driven out of the ground, are the links fixedly received between the locking dogs of hammer and pile.

A difficulty with the known method is that mounting the links on the locking dogs is time-consuming and cumbersome, in particular when it concerns a pile driven obliquely into the ground, a so-called shore.

SUMMARY OF THE INVENTION

The invention now intends to remove this difficulty. To that end it provides a method, which is characterized in that the connection between hammer and pile is established by moving the hammer and a part mounted thereon and carrying the locking dogs in axial direction towards the pile. Thereafter, the part mounted on the hammer is rotated in relation to the axial direction of the pile, for engaging the locking dogs of the part mounted on the hammer and of the pile.

The invention also relates to a device for application of the method described above. The device is characterized in that the locking dogs connected to the hammer have been mounted to a bush protruding away from the hammer in an axial direction and being supported in the direction by the hammer and rotatable in relation to the hammer in such a way that the bush can at least be partially shoved over the pile to be extracted from the ground. Thereafter the bush can be rotated so that the locking dogs of the bush will come to lie at least partially beneath the locking dogs of the pile.

When the bush has been rotated to the last-mentioned position in relation to the pile, upwardly directed strokes of the hammer can be transmitted onto the pile through the bush.

According to an embodiment of the invention, it can be provided, that the locking dogs at both parts consist of one or more ring segments.

Due to the fact that the bush and the pile may be provided with more than two circumferentially distributed dogs, the exerted pulling force can be more evenly distributed across the circumference of the pile.

However, it can also be provided, that the locking dogs at both parts can be a screw-thread consisting of one or more starts.

Instead of a continuing screw-thread, one can also use screw-thread segments, so that also in this case, one can obtain a sufficiently large bearing surface with an already limited angular rotation.

A solid construction can be obtained when the bush has an inside diameter which is slightly larger than that of the axial circumferential surface of the locking dogs mounted on the pile and the locking dogs have been attached to the inner wall of the bush.

In order to enable an easy operation of the device, it can be provided, that remote control means are present for rotating the bush in relation to the hammer.

This can be particularly advantageous in carrying out work under water.

Since in the last case, one often applies hydraulic pile driver devices, then the means can be hydraulic cylinders. However, it will be clear that other operating means, such as mechanical means, electromotive means either with or without a mechanical transmission etc., can also be applied.

In order to prevent strokes from being exerted on the bush drive, it will be provided, that the means concerned have been fixed to the hammer axially and flexibly.

DESCRIPTION OF THE DRAWINGS

The invention is further explained by means of embodiments, illustrated in the drawing, in which.

DETAILED DESCRIPTION OF THE PREFERRED EMBODIMENTS

Figure 1:
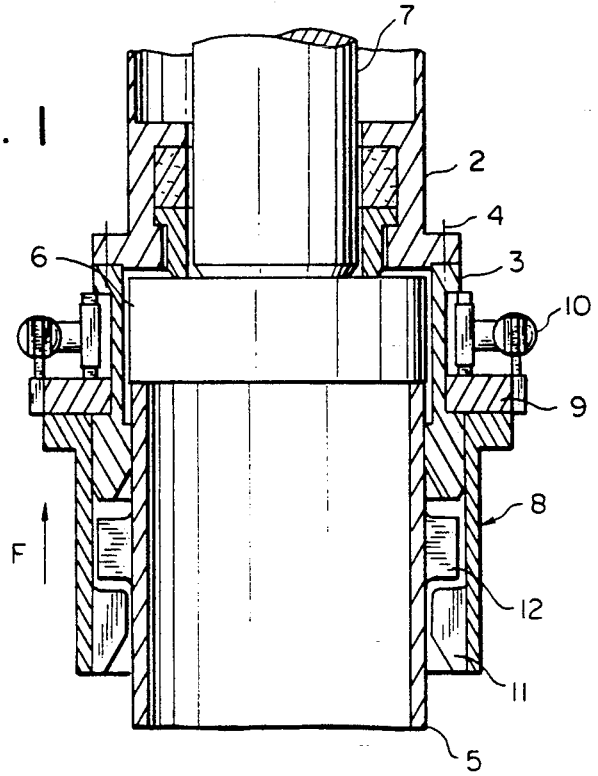
FIG. 1 diagrammatically shows a vertical section across the adjacent portions of hammer and pile with the bush shoved over the pile.

The device illustrated in the drawing comprises the piling frame 1, along which a hammer 2 is movable, which comprises an accommodating portion 3, which has been secured to the hammer by means of bolts 4.

The accommodating portion 3 can be shoved over a pile 5, which in this case has the shape of a tube, but can also have any other shape.

An impact plate 6 is fitted on the pile 5. Through the impact plate 6, the impact energy generated by the impact weight 7 is then transferred to the pile 5.

The accommodating portion 3 of the hammer 2 further cooperates with the bush 8, which extends downwardly around the pile 5. The bush 8 has been connected to a collar 9 by bolts not further indicated, in such a way that it is retained in an axial direction in relation to the hammer 2. With the help of the collar 9, the bush 8 can be rotated in relation to the hammer 2 and accommodating portion 3, such as by employing hydraulic cylinders 10. The bush 8 and the collar 9 together can also form one unity.

At its lower end, the bush 8 has been provided with locking dogs 11, which in the position shown in FIG. 1 are situated under locking dogs 12, which have been connected to the pile 5.

Figure 3:
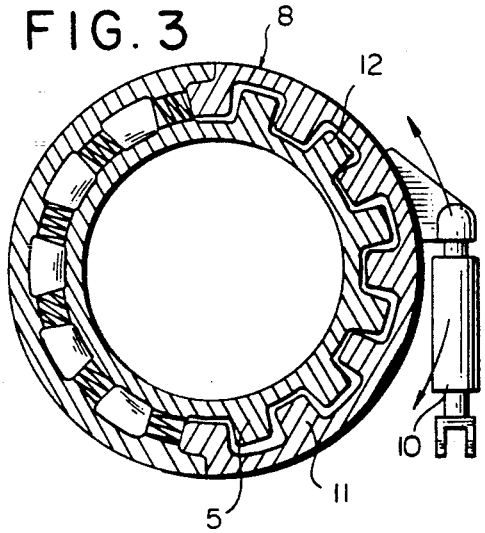
FIG. 3 diagrammatically shows cross-sections at several levels in FIG. 1 with a plan view of an operating device, which has been modified compared to that of FIG. 2.

In the right part of FIG. 3, a position has been shown in which the locking dogs 11 of the bush 8 and the locking dogs 12 of pile 5 are at the same height when shoving the bush 8 onto the pile 5, while the dogs 11 and 12 are situated between each other. When the locking dogs 11 are situated under the locking dogs 12, the bush 8 is rotated to the position as indicated in the left part of FIG. 3, so that the locking dogs will now engage when an upwardly directed force F is exerted on the bush 8.

In the embodiment illustrated in the drawing, the dogs are ring segments, so that the cooperating surfaces of the locking dogs 11 and 12 are situated in planes square to the axis of the pile 5.

As already mentioned above, the dogs can also be the segments of a screw-thread, or be in the shape of screw-thread. In the latter case, however, the angle over which the bush 8 must be rotated in order to make the locking dogs engage, will be larger.

Figure 2:
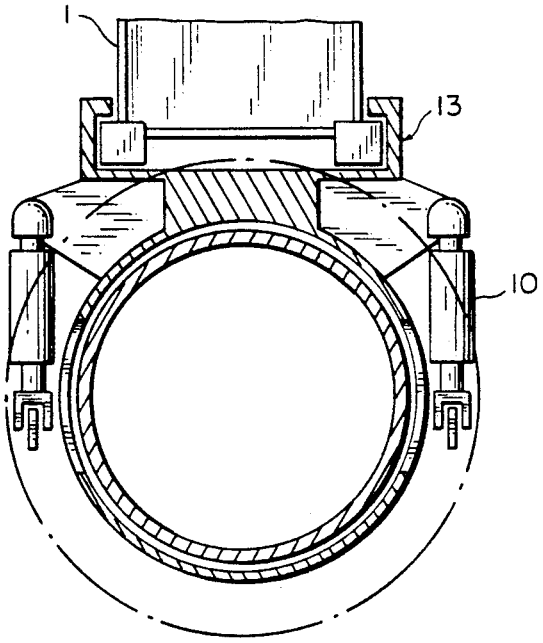
FIG. 2 diagrammatically shows a partial plan view and partial section across the device of FIG. 1.

As indicated in FIG. 2, the hydraulic cylinders 10 can be connected to a support 13, which is guided by the piling frame 13 for receiving the reaction forces exerted by the cylinders 10 upon rotation of the bush 8.

Axially flexible means (not further indicated) can be present for connecting the hydraulic cylinders 10 to the hammer 2 in order to prevent strokes from being exerted on the hydraulic cylinders.

FIG. 3 shows yet another slightly modified arrangement of the hydraulic cylinder 10 for operating the bush 8. The means for driving the bush might also be guided along the pile, in such a way that the reactional moment can be accommodated by the pile.

Further, in the drawing it has not been indicated in what way the impact weight 7 is driven, since it concerns a pile driver device of a known design, which has been constructed in such a way that one can both drive a pile into the ground with the device and extract it from the ground.

Further, it will be clear that only some possible embodiments of the invention have been illustrated in the drawing and described above and that many modifications can be made without falling outside the inventive idea.

I claim:

1. Device for driving a pile into and out of the ground, comprising:

(A) a hammer;

(B) a plurality of hammer locking dogs connected therewith, connectable to pile locking dogs mounted on a pile;

(C) a bush, the hammer locking dogs fixed thereto, protruding away from the hammer in an axial direction and supported in the axial direction by the hammer and rotatable in relation to the hammer, whereby the bush can be at least partially shoved over the pile to be extracted from the ground, and further rotatable, whereby the hammer locking dogs lie beneath the pile locking dogs;

(D) wherein the hammer and pile locking dogs include a screw-thread with at least one start.

2. Device according to claim 1, further comprising remote control means connected to the bush, for rotating the bush in relation to the hammer.

3. Device according to claim 2, wherein the means for rotating the bush in relation to the hammer are axially flexibly mounted to the hammer.

4. Device according to claim 3, wherein the means for rotating the bush in relation to the hammer are mechanical.

5. Device according to claim 3, wherein the means for rotating the bush in relation to the hammer are electrical.

6. Device according to claim 3, wherein the means for rotating the bush in relation to the hammer are hydraulic.

7. Device for driving a pile into and out of the ground, comprising:

(A) a hammer;

(B) a plurality of hammer locking dogs connected therewith, connectable to pile locking dogs mounted on a pile;

(C) a bush, the hammer locking dogs fixed thereto, protruding away from the hammer in an axial direction and supported in the axial direction by the hammer and rotatable in relation to the hammer, whereby the bush can be at least partially shoved over the pile to be extracted from the ground, and further rotatable, whereby the hammer locking dogs lie beneath the pile locking dogs;

(D) wherein the hammer and pile locking dogs include at least one screw-thread segment.

8. Device according to claim 7, further comprising remote control means connected to the bush, for rotating the bush in relation to the hammer.

9. Device according to claim 8, wherein the means for rotating the bush in relation to the hammer are axially flexibly mounted to the hammer.

10. Device according to claim 9, wherein the means for rotating the bush in relation to the hammer are mechanical.

11. Device according to claim 9, wherein the means for rotating the bush in relation to the hammer are electrical.

12. Device according to claim 9, wherein the means for rotating the bush in relation to the hammer are hydraulic.

* * * * *

UNITED STATES PATENT AND TRADEMARK OFFICE

CERTIFICATE OF CORRECTION

PATENT NO. : 5,310,287

DATED : May 10, 1994

INVENTOR(S) : Dik ARENTSEN

It is certified that error appears in the above-indentified patent and that said Letters Patent is hereby corrected as shown below:

On the title sheet, line[73], "THC" should read --IHC--

Signed and Sealed this

Fifteenth Day of November, 1994

*Attest:*

Bruce Lehman

BRUCE LEHMAN

*Attesting Officer*

*Commissioner of Patents and Trademarks*